US006427721B1

(12) United States Patent
Zenker et al.

(10) Patent No.: US 6,427,721 B1
(45) Date of Patent: Aug. 6, 2002

(54) HYDRAULIC VALVE ARRANGEMENT WITH LOCKING FUNCTION

(75) Inventors: Siegfried Zenker, Kirchseeon (DE); Carsten Christensen, Broager; Thorkild Christensen, Sønderborg, both of (DK)

(73) Assignee: Sauer-Danfoss (Nordberg) A/S, Nordborg (DK)

( * ) Notice: Subject to any disclaimer, the term of this patent is extended or adjusted under 35 U.S.C. 154(b) by 0 days.

(21) Appl. No.: 09/609,843

(22) Filed: Jul. 5, 2000

(30) Foreign Application Priority Data

Jul. 6, 1999 (DE) ..... 199 31 142

(51) Int. Cl.[7] ..... F15B 13/04
(52) U.S. Cl. ..... 137/596.2; 91/447
(58) Field of Search ..... 91/447; 137/596.2

(56) References Cited

U.S. PATENT DOCUMENTS 6,220,289 B1 * 4/2001 Zenker et al. ..... 91/447 X

* cited by examiner

*Primary Examiner*—Gerald A. Michalsky
(74) *Attorney, Agent, or Firm*—Altera Law Group, LLC

(57) ABSTRACT

The invention concerns a hydraulic valve arrangement with locking function. It has a control valve (9), which in two operating positions (11, 12) connects one motor connection (A) with a pump connection and a second motor connection (B) with a tank connection and vice versa, and in a locking position (10) separates both motor connections (A, B) from pump and tank connection. Further, there are two lock valves (16, 17), each connected between the control valve (9) and one of the motor connections (A, B). This valve arrangement is characterised in that for each lock valve (16, 17) a pressure release valve (18, 19) is provided, whose operating member (30, 30*a*) is loadable in the closing direction by a first chamber pressure and an additional force acting in a first chamber (31, 31*a*) and in the opening direction by a control pressure acting in a second chamber (32, 32*a*), and that the control pressure in dependence of the position of the control valve (9) has a lower value, which is equal to the first chamber pressure, and an upper value, which exceeds the first chamber value by such a value that the oppositely acting closing force is overcome. This gives a very high degree of operation safety.

10 Claims, 3 Drawing Sheets

HYDRAULIC VALVE ARRANGEMENT WITH LOCKING FUNCTION

Figure 1:
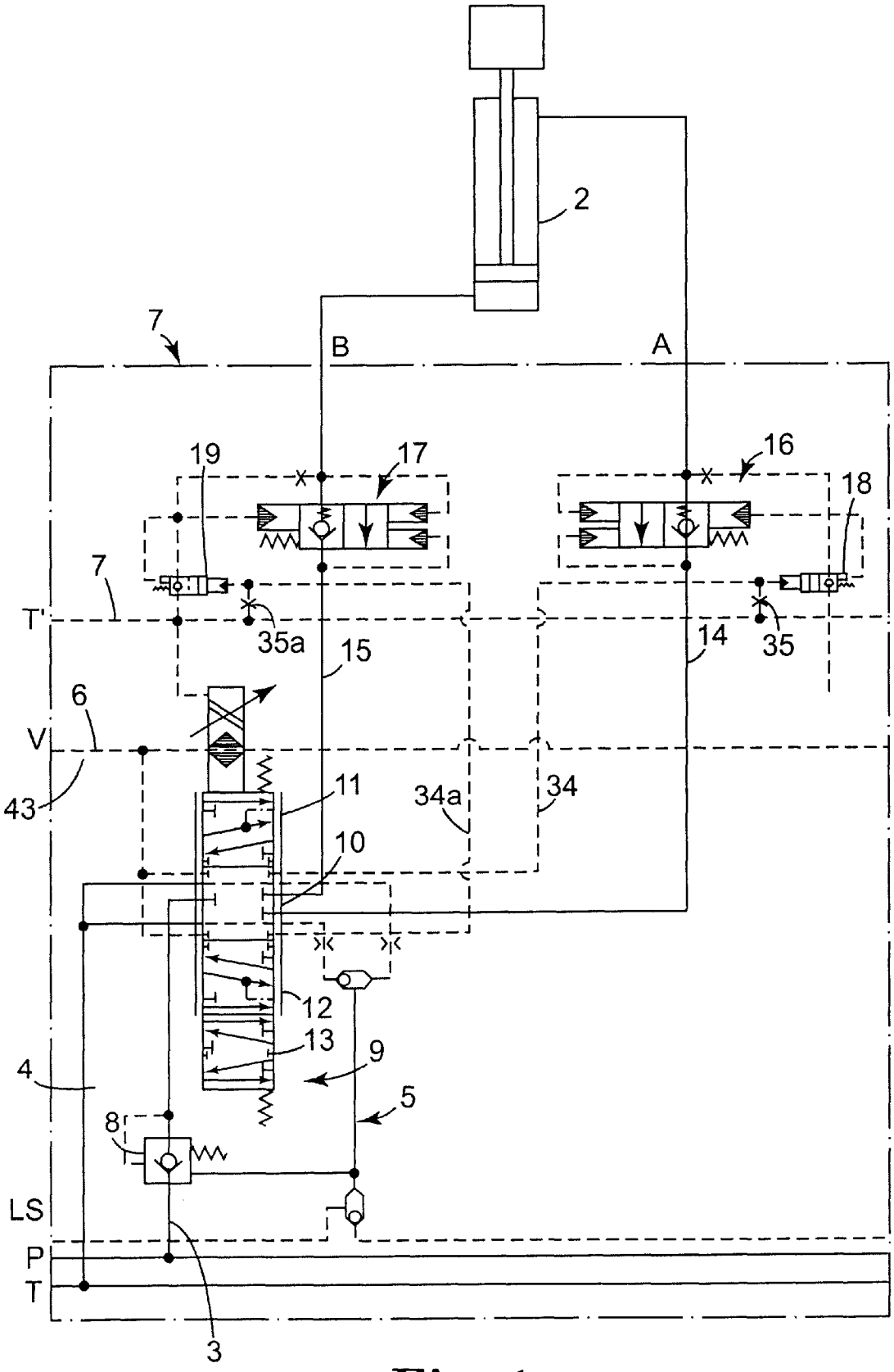

The invention relates to a hydraulic valve arrangement with locking function, with a control valve, which in two operating positions connects one motor connection with a pump connection and a second motor connection with a tank connection and vice versa, and in a locking position separates both motor connections from pump and tank connection, and with two lock valves, each connected between the control valve and one of the motor connections.

Known hydraulic valve arrangements of this kind are mainly, but not exclusively, used in tractors, which can be provided with auxiliary tools, like for example snow clearance vehicles or street cleaning vehicles. The lock valves have a piston loaded by a spring and limiting a spring chamber, the spring chambers being pressure releasable. The pressure release of the spring chambers, which is required to hold the lock valves open in the operating positions and in the floating position of the control valve, occurs in that release channels end in the bore of the control valve and their end is overruled by the slide of the control valve. In certain cases, however, it has turned out that errors occur in the function, particularly in the locking function.

The task of the invention is to provide a hydraulic valve arrangement as mentioned in the introduction, which has a better operational behaviour.

According to the invention, this task is solved in that for each lock valve a pressure release valve is provided, whose operating member is loadable in the closing direction by a first chamber pressure acting in a first chamber and an additional force and in the opening direction by a control pressure acting in a second chamber, and that the control pressure in dependence of the position of the control valve has a lower value, which is equal to the first chamber pressure, and an upper value, which exceeds the first chamber value by such a value that the oppositely acting closing force is overcome.

The application of pressure controlled pressure release valves gives a large freedom in dimensioning, which is advantageous with regard to space utilisation and the solving of leakage problems. The dependence of the control pressure on the first chamber pressure ensures that variations in this pressure, which, particularly in large systems, cannot be avoided, have no influence on the mode of operation of the pressure release valves. This gives a high degree of operational security.

This is particularly the case when the first chamber pressure is equal to the tank pressure.

It is advantageous that the upper value of the control pressure exceeds the first chamber pressure by a constant value. This enables a particularly safe pressure release.

With regard to design, it is recommended that the pressure release valves are lifting valves and their operating elements are pistons. Such lifting valves with pistons can easily be dimensioned so that in the closed position they are completely tight.

Favourable is a pressure source producing the upper value of the control pressure, said source being separated from or connected with the second chamber by means of the control valve, and an blow-off throttle between the first and the second chambers. A connection will produce the upper value of the control pressure by means of the pressure source, a separation will produce the lower value of the control pressure by means of the blow-off throttle.

It is advantageous that the pressure source producing the upper value of the control pressure is formed by the outlet of a pressure control valve fed by the pump pressure, said valve being loaded in the closing direction by the outlet pressure and in the opening direction by the tank pressure and a spring. Such a pressure source is easy to make and can without problems be arranged in a hydraulic arrangement.

It is recommended that the pressure source producing the upper value of the control pressure also produces the pilot pressure for the electrical activation of the control valve. Thus the pressure source is multiply useful.

In a preferred embodiment it is ensured that a load pressure sensing system is provided, which is independent of the control pressure, and which is connected with. the tank in the locking position of the control valve. The clear separation of control pressure and load pressure enables the provision, in the locking position, of the known and desired connection of the load pressure sensing system with the tank, without having to put up with disadvantages in the control pressure.

Further, it is advantageous that in one operating position the control valve connects the pressure source producing the upper value of the control pressure with the second chamber of the first pressure release valve and the other operating position connects it with the second chamber of the second pressure release valve. The control valve therefore also secures the correct direction of the inlet of control pressure to the belonging pressure release valve.

It is also advantageous that additionally to the two operating positions and the locking position, the control valve has a floating position, in which the second chambers of both pressure release valves are connected with the pressure source producing the upper value of the control pressure. The valve arrangement can therefore additionally also be equipped with a floating position, in which both lock valves are kept open.

Figure 2:
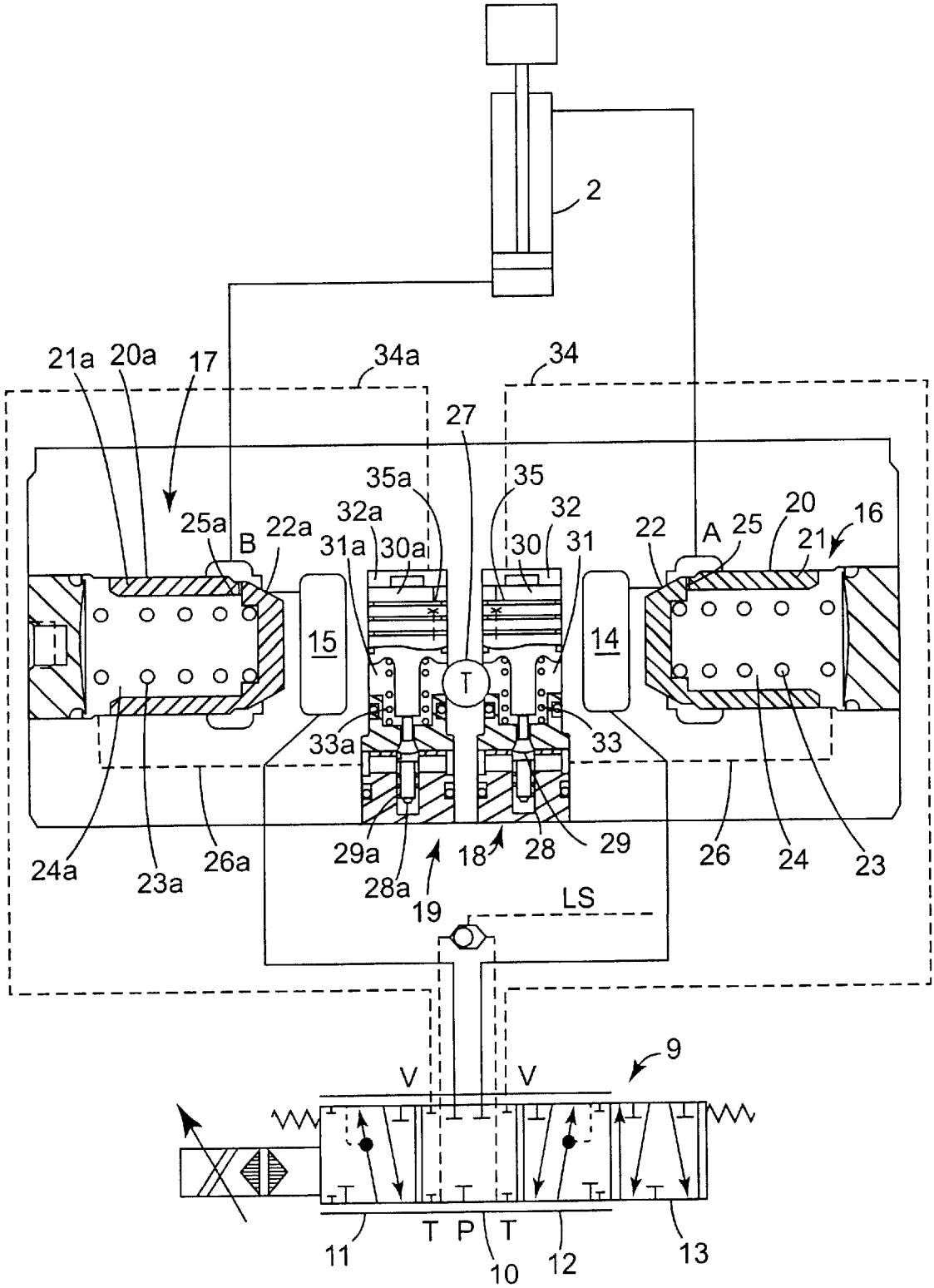

In the following, the invention is described on the basis of preferred embodiments in connection with the drawings, showing:

FIG. 1 a diagram of an embodiment of the valve arrangement according to the invention FIG. 2 details of the valve arrangement of FIG. 1

Figure 3:
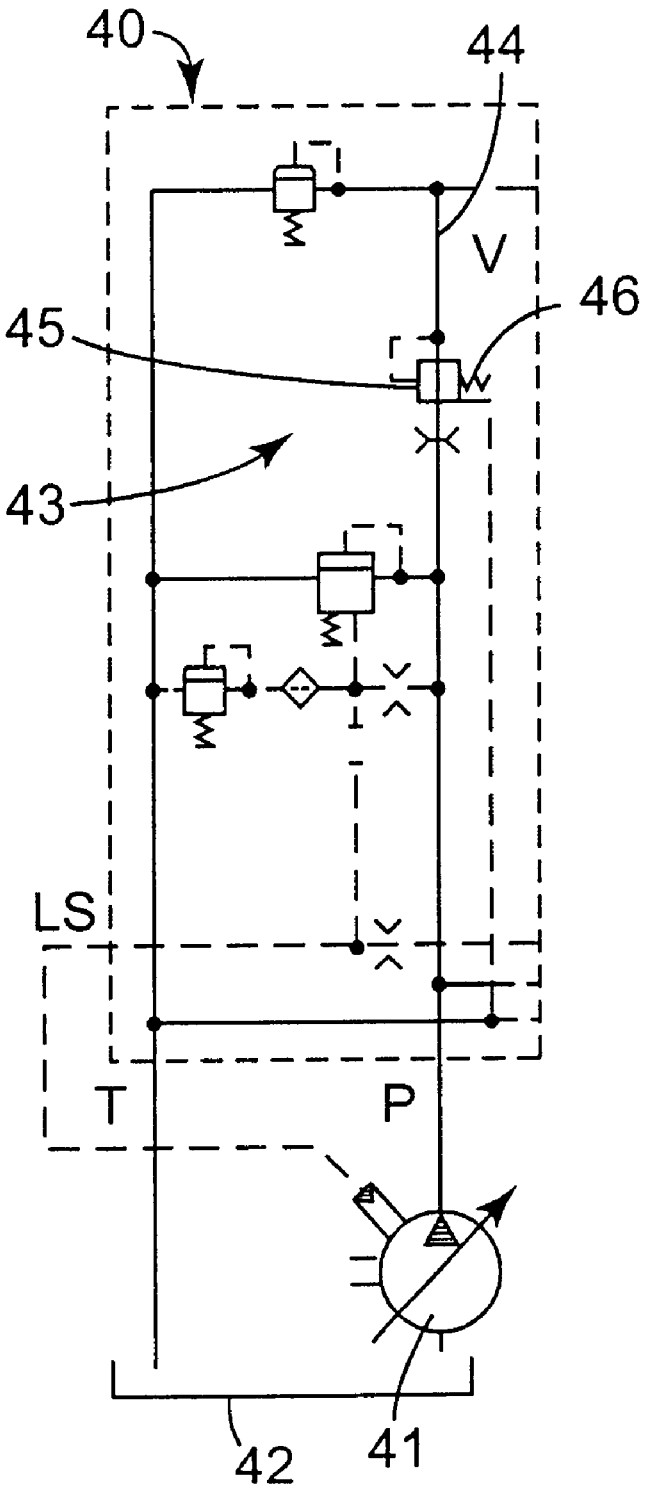

FIG. 3 a diagram comprising the pressure source

FIG. 1 shows a module 1, which serves to operate a motor 2. To a high degree, its dimensions and embodiment corresponds to usual embodiments. The module 1 has a connection carrying pump pressure P and being connected with a pump line 3, a connection carrying tank pressure T and being connected with a tank line 4, a connection carrying load pressure LS and being connected with a load pressure system 5, a connection supplying the upper value V of a control pressure and being connected with a control pressure line 6, as well as two motor connections A and B, which serve to connect the motor 2. Besides, a second connection T' is provided, which is connected with a second tank line 7.

Via a load pressure controlled compensation valve 8, the pump line 3 leads to a control valve 9, which is made as a slide valve and can assume a locking position 10, two operating positions 11 and 12 as well as a floating position 13. The control valve 9 operates two motor lines 14 and 15 leading to the motor connection A or B, respectively, via a lock valve 16 or 17, respectively. Each lock valve is provided with a pressure release valve 18 or 19, respectively, as described in detail in connection with FIG. 2.

The lock valve 16 has a piston 21 guided in a housing bore 20, which piston on the front side cooperates with a valve seat 22, is loaded by a closing spring 23 and limits a spring chamber 24. This chamber is connected via a throttle 25 with the second part of the motor line 14 leading to the motor connection A and via a release line 26 and the pressure release valve 18 with a line 27 leading to the tank line 4. The diameter of the valve seat 22 is so much smaller than the outer diameter of the piston 21 that with predominant pressure inside the seat the lock valve can open without pressure release of the spring chamber 24, with predominant pressure outside the seat the lock valve can only open with pressure release of the spring chamber 24. The lock valve 17 has the same embodiment, therefore the same reference signs, however with the addition "a" are used. Here the release of the pressure chamber 24*a* occurs via the release line 26*a* and the pressure release valve 19 to the line 27 carrying tank pressures.

The closure element 28 of the pressure release valve 18 is pressed into a tight closing position by a spring 29. For the opening of the pressure release valve 19, an operating member 30 in the shape of a piston is provided, which is arranged between a first chamber 31 and a second chamber 32. Via a line 27, the chamber 31 is supplied with a first chamber pressure, here the tank pressure, and as supplementary force acting in the closing direction it has a spring 33. Via a line 34, the second chamber 32 can be supplied with the control pressure V. Both chambers are connected with each other via a blow-off throttle 35, so that with failing supply of the control pressure, the pressure in the second chamber 32 is equal to the first chamber pressure. The pressure release valve 19 has the same embodiment, therefore again the reference signs are supplemented by an "a".

FIG. 3 shows a pump module 40 with a pump 41 controlled by the load pressure LS and a tank 42. The outlet 44 of a pressure control valve 45 serves as pressure source 43 for the upper value of the control pressure, said valve being loaded in the opening direction by the tank pressure and a spring 46 and in the closing direction by the outlet pressure, as indicated by the dotted lines. Therefore, the upper value of the control pressure exceeds the first chamber pressure by a constant value. In the second chamber 32 or 32*a*, respectively, it produces a force, which overcomes the closing force in the first chamber 31 or 31*a*, respectively. As can be seen from FIG. 1, the upper value of the control pressure is also used to support the electrical operation of the control valve 9.

This gives the following modes of operation:

1. Locking Function

The control valve 9 assumes the position 10 shown, which corresponds to the neutral position. Both lines 34, 34*a*, which lead to the second chambers 32 and 32*a*, respectively, of the pressure release valves 19 and 18, respectively, are separated from the pressure source 43. The first chambers 31 and 31*a*, respectively, are submitted to the tank pressure, which, due to the blow-off throttles 35 and 35*a*, respectively, rules also in the second chambers 32 and 32*a*, respectively. Both pressure release valves 18 and 19 are therefore closed. The lock valves 16 and 17 are in the locking position. Therefore, the motor connections A and B are separated from the pump line 3. The motor 2 has a fixed position. As the pressure release valves 18 and 19 close tion. As the pressure release valves 18 and 19 close tightly, there is no risk that a change of the pressure conditions, like, for example, a negative load at the motor 2, will cause a lock valve to open. In this connection the lines of the load pressure sensing system 5 can be connected with the tank T, as commonly known and wanted.

2. Operating Function

This corresponds to the position 11 or 12 of the control valve 9. In the operating position 11, the supplied pressure fluid pushes the lock valve 17 open. At the same time, the pressure release valve 18 is opened, as via the line 34 control pressure with its upper value is supplied. This is because in the control valve 9 a corresponding connection with the pressure source 43 had been established. Consequently, the spring chamber 24 of the lock valve 16 is pressure released. Therefore, it can also open under the influence of the returning pressure fluid. Similar conditions occur in the operating position 12.

3. Floating Function

In the floating position 13, both lines 34 and 34*a* are connected to the pressure source 43 by the control valve 9. Thus, both pressure release valves 18 and 19 are opened. Both spring chambers 24 and 24*a* are released. Small pressure increases on one of the motor connections A or B are sufficient to open the lock valves 16 and 17. The motor can thus adjust freely in dependence of its outer loads.

In both positions the pressure release valves work with a high accuracy. If the second chambers 32 or 32*a*, respectively, are separated from the pressure source 43, the blow-off throttle 35 or 35*a*, respectively, cause them to carry first chamber or tank pressure. There is no pressure difference, which could adjust the operating member 30 or 30*a*, respectively. If there is a connection between the second chamber and the pressure source 43, the pressure in the second chamber 32 or 32*a*, respectively, always exceeds the pressure in the first chamber 31 or 31*a*, respectively, by a predetermined amount, so that the piston is held in the opening position by a constant force.

Several deviations from the embodiment shown can be made without abandoning the basic idea of the invention. For example, the blow-off throttles 35 or 35*a*, respectively, must not be provided in the pressure release valves, but can be arranged in another place, for example in the slide of the control valve 9.

The dependence of the control pressure on the position of the control valve can be realised in many ways. Instead of the switching areas on the slide of the control valve 9, also a switch operated simultaneously with the control valve can be used. With an electrically operable control valve, the electrical signal may influence the control pressure. With a bus-controlled valve, the bus signals can be used for the control.

What is claimed is:

1. Hydraulic valve arrangement with locking function, with a control valve, which in two operating positions connects one motor connection with a pump connection and a second motor connection with a tank connection and vice versa, and in a locking position separates both motor connections from pump and tank connection, and with two lock valves, each connected between the control valve and one of the motor connections, wherein for each lock valve a pressure release valve is provided, whose operating member is loadable in the closing direction by a first chamber pressure and an additional force acting in a first chamber and in the opening direction by a control pressure acting in a second chamber, and that the control pressure in dependence of the position of the control valve has a lower value, which is equal to the first chamber pressure, and an upper value, which exceeds the first chamber value by such a value that the oppositely acting closing force is overcome.

2. Valve arrangement according to claim 1, wherein the first chamber pressure is equal to the tank pressure.

3. Valve arrangement according to claim 1, wherein the upper value of the control pressure exceeds the first chamber pressure by a constant value.

4. Valve arrangement according to claim 1, wherein the pressure release valves are lifting valves and their operating elements are pistons.

5. Valve arrangement according to claim 1, wherein a pressure source producing the upper value of the control pressure, said source being separated from or connected with the second chamber by means of the control valve, and an blow-off throttle between the first and the second chambers.

6. Valve arrangement according to claim 5, wherein the pressure source producing the upper value of the control pressure is formed by the outlet of a pressure control valve fed by the pump pressure, said valve being loaded in the closing direction by the outlet pressure and in the opening direction by the tank pressure and a spring.

7. Valve arrangement according to claim 5, wherein the pressure source producing the upper value of the control pressure also produces a pilot pressure for an electrical activation of the control valve.

8. Valve arrangement according to claim 1, wherein a load pressure sensing system is provided, which is independent of the control pressure, and which is connected with the tank in the locking position of the control valve.

9. Valve arrangement according to claim 1, wherein in one operating position the control valve connects a pressure source producing the upper value of the control pressure with the second chamber of the first pressure release valve and the other operating position connects it with the second chamber of the second pressure release valve.

10. Valve arrangement according to claim 1, wherein additionally to the two operating positions and the locking position, the control valve has a floating position, in which the second chambers of both pressure release valves are connected with a pressure source producing the upper value of the control pressure.

* * * * *